US011001063B2

(12) United States Patent
Kimura

(10) Patent No.: US 11,001,063 B2
(45) **Date of Patent: *May 11, 2021**

(54) MAINTENANCE APPARATUS AND LIQUID EJECTION APPARATUS

(71) Applicant: TOSHIBA TEC KABUSHIKI KAISHA, Tokyo (JP)

(72) Inventor: Kazuhisa Kimura, Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/688,912

(22) Filed: Nov. 19, 2019

(65) Prior Publication Data

US 2020/0086646 A1 Mar. 19, 2020

Related U.S. Application Data

(63) Continuation of application No. 15/917,901, filed on Mar. 12, 2018, now Pat. No. 10,556,432.

(30) Foreign Application Priority Data

Mar. 23, 2017 (JP) ..... JP2017-058089

(51) Int. Cl.
*B41J 29/38* (2006.01)
*B41J 2/165* (2006.01)
*B41J 2/175* (2006.01)

(52) U.S. Cl.
CPC ..... *B41J 2/16532* (2013.01); *B41J 2/16535* (2013.01); *B41J 2/175* (2013.01);
(Continued)

(58) Field of Classification Search
CPC ..... B41J 2/16532; B41J 2002/16555; B41J 2235/27; B41J 2/16535; B41J 2/16552
See application file for complete search history.

(56) References Cited

U.S. PATENT DOCUMENTS 4,959,662 A 9/1990 Kobayashi
5,343,228 A 8/1994 Takada
(Continued)

FOREIGN PATENT DOCUMENTS

JP H04140146 A 5/1992
JP H05201028 A 8/1993
(Continued)

OTHER PUBLICATIONS

Chinese Office Action dated Nov. 22, 2019, mailed in counterpart Chinese Application No. 201810153699.3, 12 pages (with translation).
(Continued)

*Primary Examiner* — Lam S Nguyen
(74) *Attorney, Agent, or Firm* — Kim & Stewart LLP

(57) ABSTRACT

According to one embodiment, a maintenance apparatus includes a first suction nozzle having a first suction port facing a first nozzle row through which a first liquid can be ejected, the first nozzle row including nozzles aligned in a first direction on a nozzle plate, and a second suction nozzle having a second suction port facing a second nozzle row through which a second liquid can be ejected, the second nozzle row including nozzles aligned in the first direction on the nozzle plate and parallel to the first nozzle row.

16 Claims, 6 Drawing Sheets

(52) U.S. Cl.
CPC ..... *B41J 2/17596* (2013.01); *B41J 29/38* (2013.01); *B41J 2002/16594* (2013.01); *B41J 2202/12* (2013.01); *B41P 2235/27* (2013.01)

(56) References Cited

U.S. PATENT DOCUMENTS

| | | | | |
|---|---|---|---|---|
| 6,062,672 | A | 5/2000 | Ishize et al. | |
| 6,663,218 | B2 | 12/2003 | Uchida | |
| 8,152,266 | B2 | 4/2012 | Sekiya et al. | |
| 8,474,949 | B2 | 7/2013 | Kimura et al. | |
| 10,500,850 | B2 | 12/2019 | Govyadinov et al. | |
| 2008/0174631 | A1 | 7/2008 | Habashi | |
| 2010/0194829 | A1 | 8/2010 | Sekiya | |
| 2011/0199427 | A1 | 8/2011 | Fukasawa et al. | |
| 2012/0105539 | A1* | 5/2012 | Kimura | B41J 2/16532 347/30 |
| 2012/0212542 | A1* | 8/2012 | Kimura | B41J 2/16552 347/33 |
| 2012/0229532 | A1 | 9/2012 | Chen et al. | |
| 2014/0240395 | A1 | 8/2014 | Shindo et al. | |
| 2014/0267490 | A1 | 9/2014 | Kuroda et al. | |
| 2015/0375543 | A1 | 12/2015 | Barnett et al. | |
| 2016/0152030 | A1 | 6/2016 | Nawano et al. | |
| 2016/0263896 | A1 | 9/2016 | Ono et al. | |

FOREIGN PATENT DOCUMENTS

| | | | |
|---|---|---|---|
| JP | H0671897 | A | 3/1994 |
| JP | 2000062207 | A | 2/2000 |
| JP | 2001328284 | A | 11/2001 |
| JP | 2010105310 | A | 5/2010 |
| JP | 2010179534 | A | 8/2010 |
| JP | 2011148132 | A | 8/2011 |
| JP | 2012091419 | A | 5/2012 |
| WO | 2016068909 | A1 | 5/2016 |

OTHER PUBLICATIONS

Japanese Office Action dated Jan. 5, 2021, mailed in counterpart Japanese Application No. 2017-058089, 6 pages (with translation).

* cited by examiner

MAINTENANCE APPARATUS AND LIQUID EJECTION APPARATUS

CROSS-REFERENCE TO RELATED APPLICATIONS

This application is a continuation of U.S. patent application Ser. No. 15/917,901, filed on Mar. 12, 2018, which is based upon and claims the benefit of priority from Japanese Patent Application No. 2017-058089, filed Mar. 23, 2017, the entire contents of each of which are incorporated herein by reference.

FIELD

Embodiments described herein relate generally to a maintenance apparatus and a liquid ejection apparatus.

BACKGROUND

In a known liquid ejection apparatus, nozzles for ejecting liquid onto a recording medium can be selected from a plurality of nozzles arranged on a nozzle plate. In such a liquid ejection apparatus, a maintenance apparatus that suctions and removes residual liquid or dust, such as paper powder, or the like adhered to the periphery of nozzles is provided. In a liquid ejection apparatus having multiple nozzle rows, a suction apparatus moves along the nozzle rows and removes the liquid or the like on the nozzle rows via a common suction port.

DETAILED DESCRIPTION

In general, according to one embodiment, a maintenance apparatus includes a first suction nozzle having a first suction port facing a first nozzle row through which a first liquid can be ejected, the first nozzle row including nozzles aligned in a first direction on a nozzle plate, and a second suction nozzle having a second suction port facing a second nozzle row through which a second liquid can be ejected, the second nozzle row including nozzles aligned in the first direction on the nozzle plate and parallel to the first nozzle row.

Hereinafter, a liquid ejection apparatus 1 and a maintenance apparatus 14 according to an embodiment will be described with reference to FIGS. 1 through 7. It should be noted that the drawings are schematic and are drawn as appropriate with exaggeration and omissions for purposes of explanatory convenience. In general, components are not drawn to scale.

Figure 1:
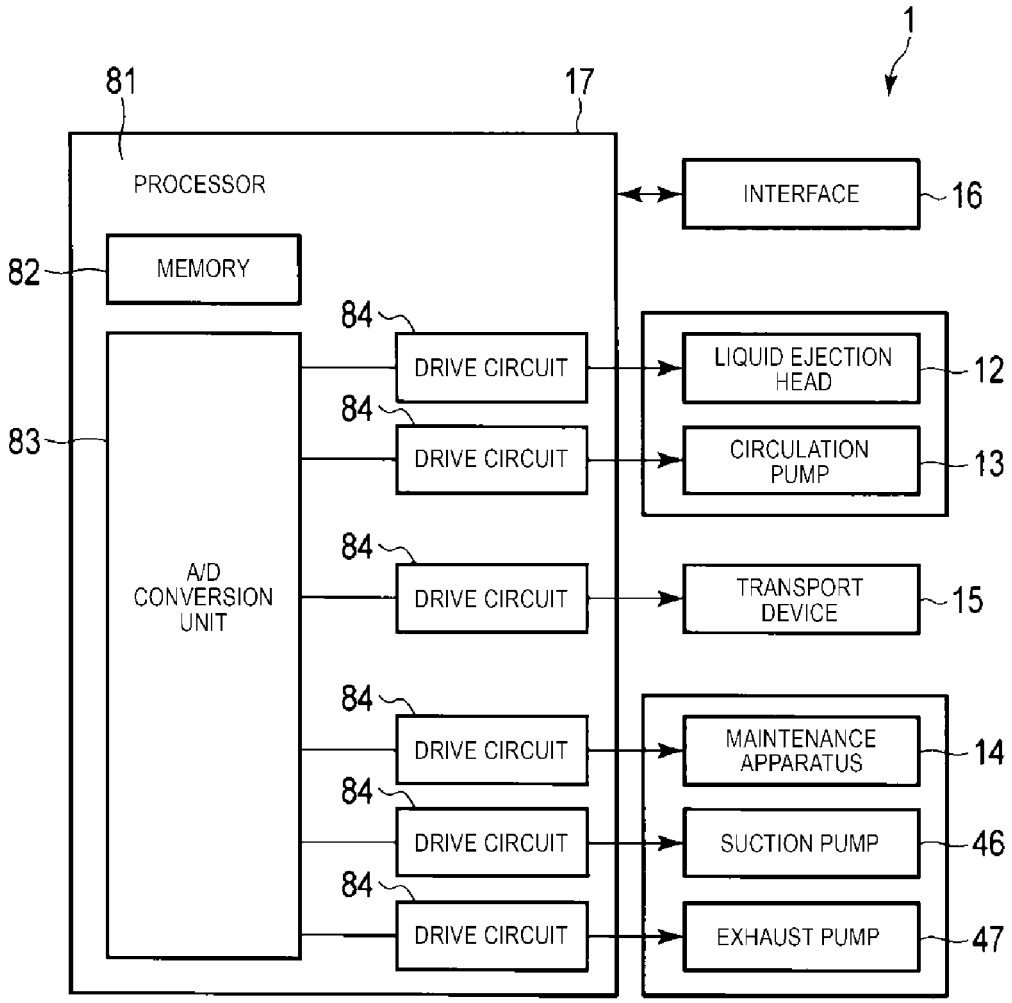
FIG. 1 is a block diagram of a liquid ejection apparatus according to an embodiment.
Figure 2:
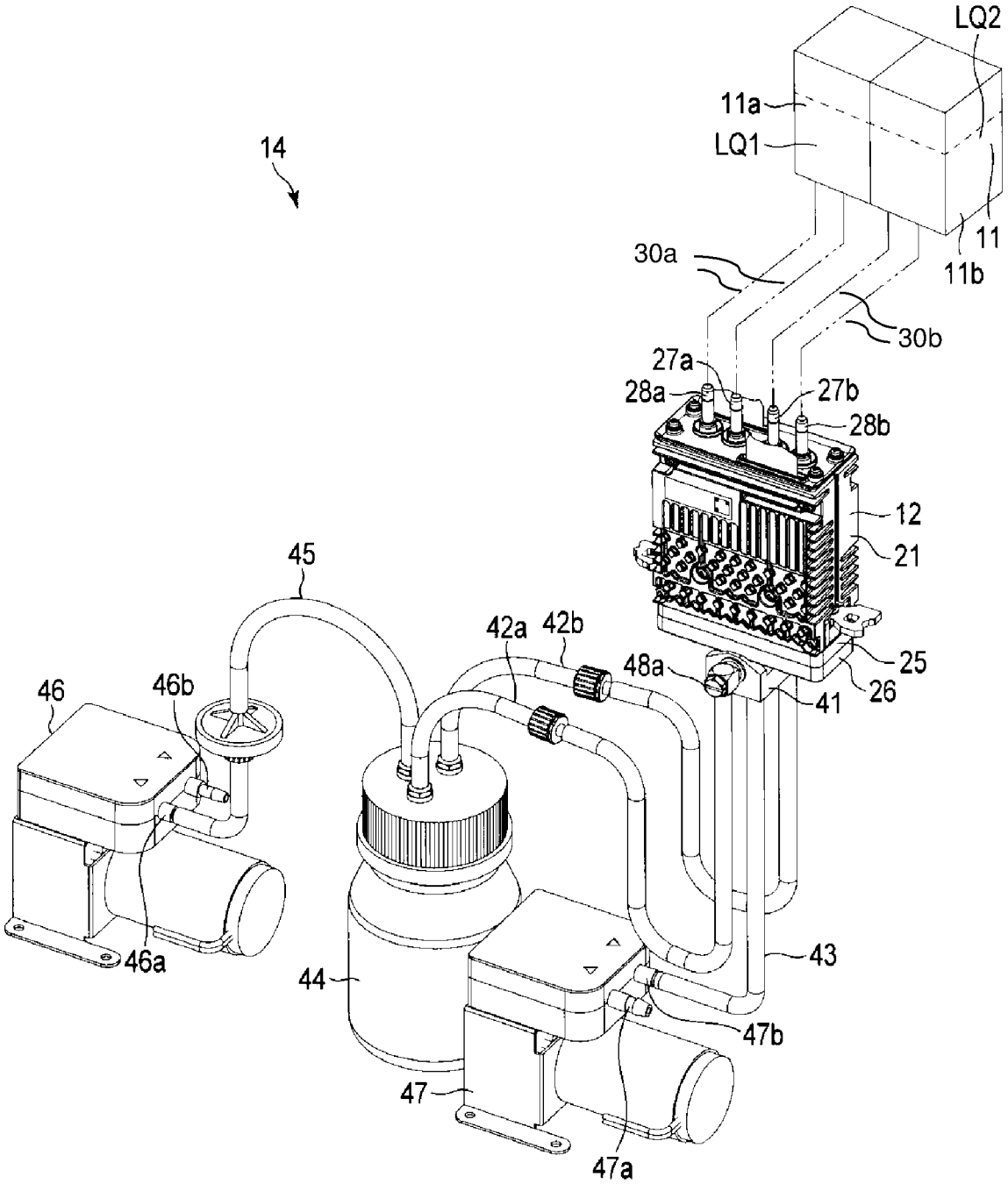
FIG. 2 is a perspective view of a maintenance apparatus.
Figure 3:
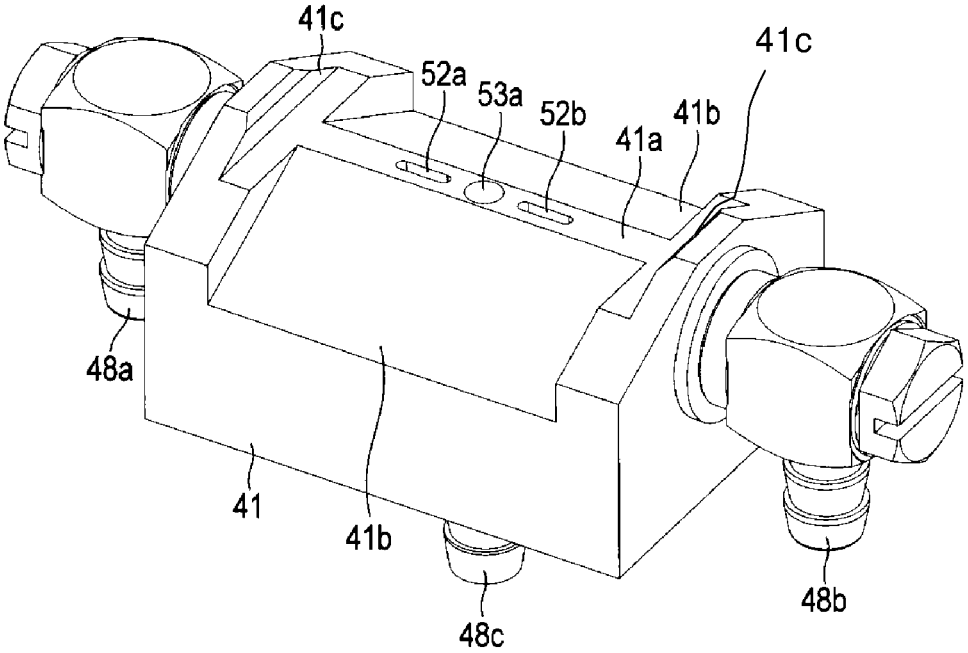
FIG. 3 is a perspective view illustrating a suction head of a maintenance apparatus.
Figure 4:
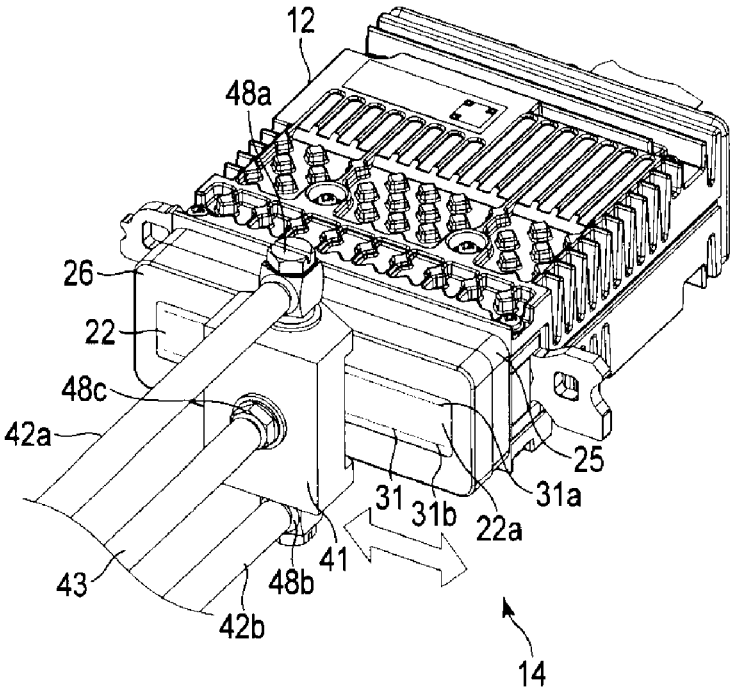
FIG. 4 is a perspective view of a maintenance apparatus.
Figure 5:
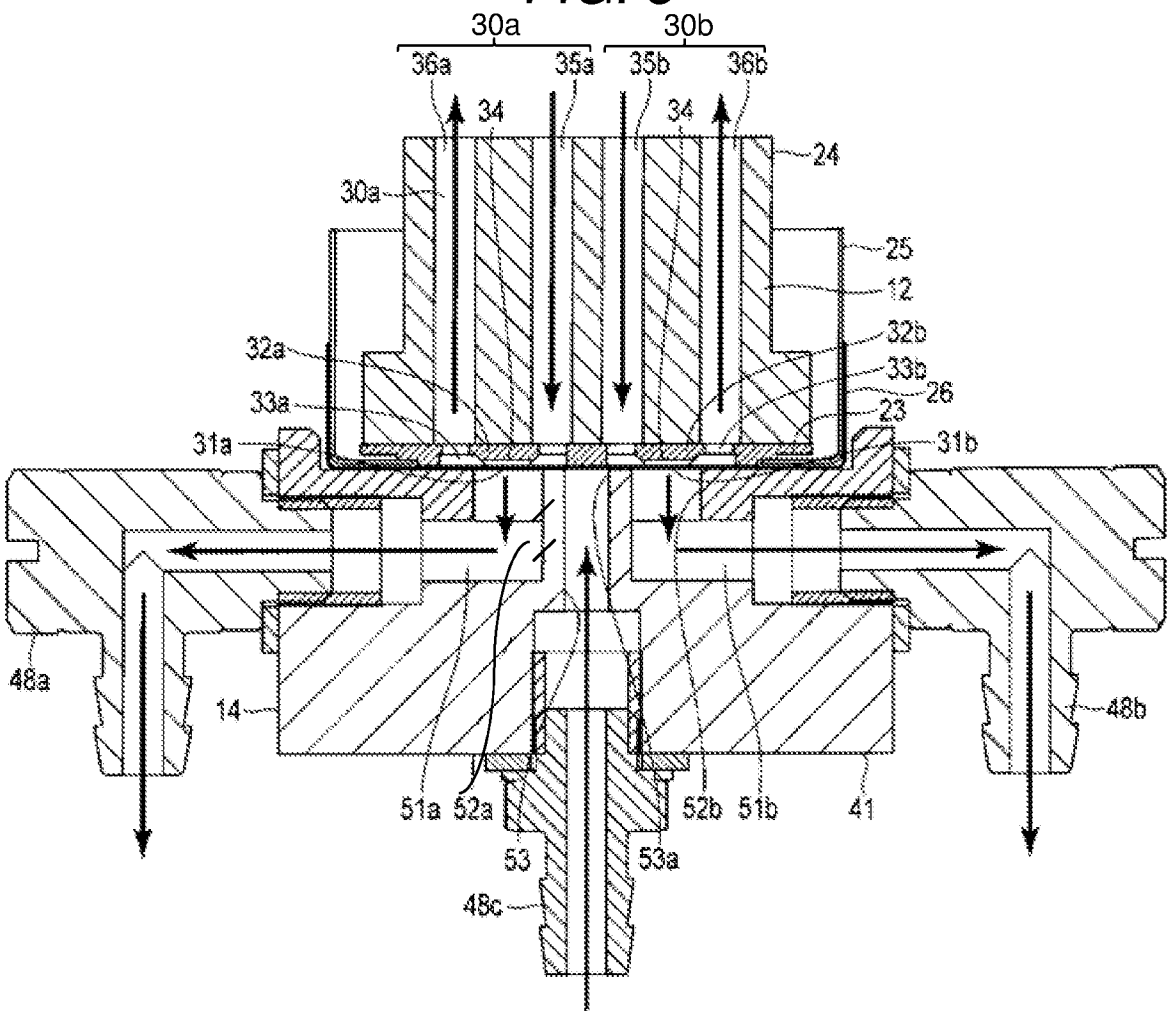
FIG. 5 is a cross-sectional view of a maintenance apparatus.
Figure 6:
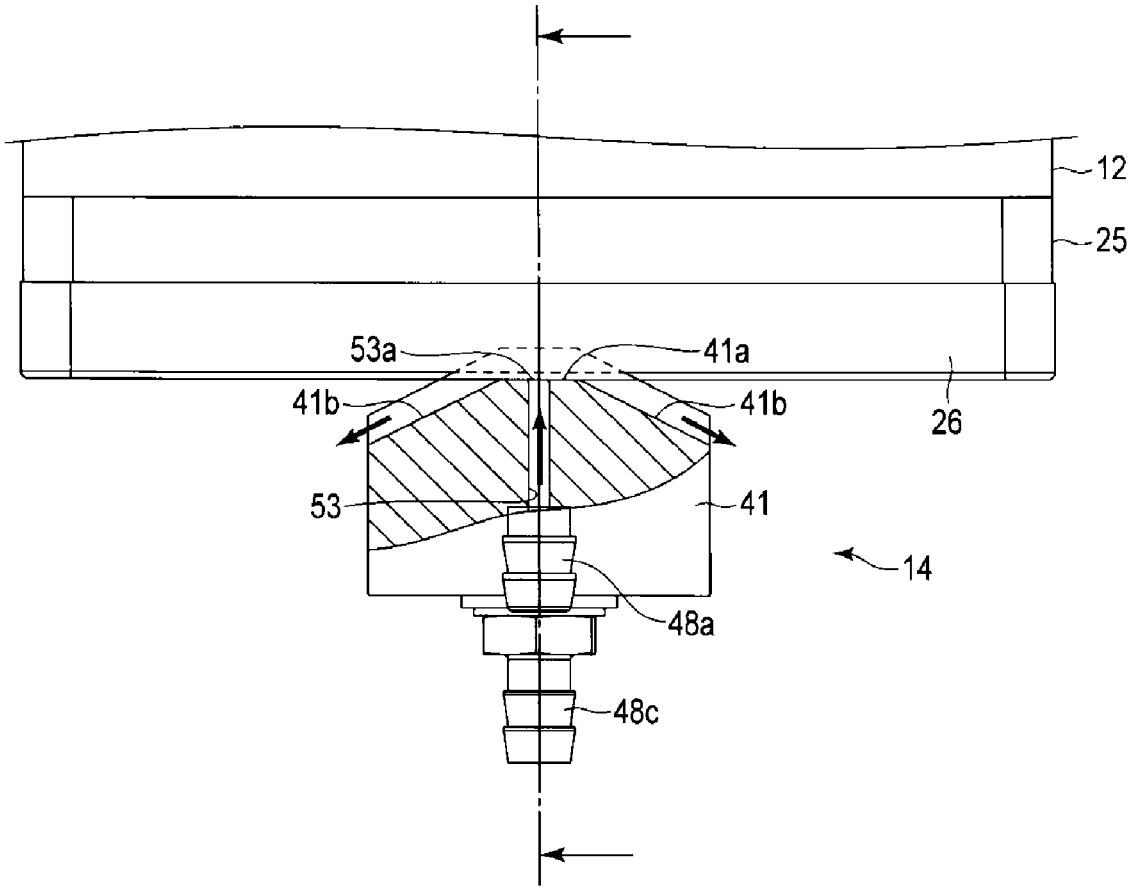
FIG. 6 is a partial cross-sectional side view of a maintenance apparatus.
Figure 7:
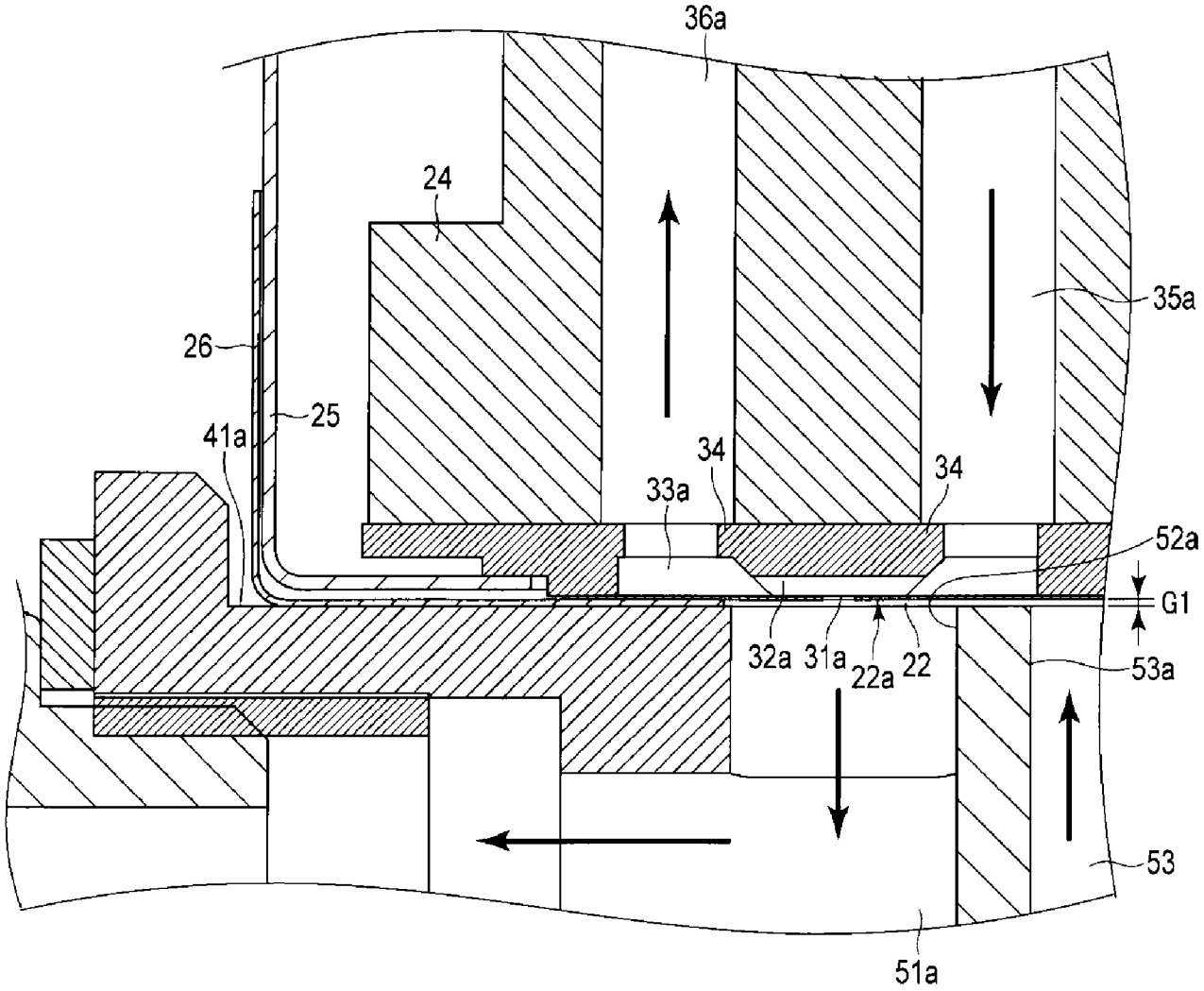
FIG. 7 is an enlarged cross-sectional view of a portion of a maintenance apparatus.

FIG. 1 is a block diagram of the liquid ejection apparatus 1, and FIG. 2 is a perspective view of the maintenance apparatus. FIGS. 3 and 4 are perspective views of a portion of the maintenance apparatus. FIGS. 5 to 7 are cross-sectional views of a portion of the maintenance apparatus.

As illustrated in FIGS. 1 and 2, the liquid ejection apparatus 1 is, for example, an ink jet recording apparatus and includes an ink tank 11 that stores liquid, a liquid ejection head 12 connected to the ink tank 11, a circulation pump 13 that circulates ink in a circulation path passing through the liquid ejection head 12 and the ink tank 11, a maintenance apparatus 14 that performs maintenance of the liquid ejection head 12, a transport device 15 for transporting a recording medium and the maintenance apparatus in a transportation path including a printing position which faces the liquid ejection head 12, an interface 16, and a control device 17.

The liquid ejection head 12 is a circulation type head that is connected to the ink tank 11 and circulates ink between the liquid ejection head 12 and the ink tank 11. The liquid ejection head 12 ejects, for example, ink as liquid so as to form a desired image on a recording medium disposed to face the liquid ejection head 12.

The ink tank 11 stores liquid to be supplied to the liquid ejection head 12. In the present embodiment, the ink tank 11 includes two ink chambers 11*a* and 11*b* that hold two different types of liquid LQ1 and LQ2, respectively. For example, liquids LQ1 and LQ2 are different colored inks.

As illustrated in FIGS. 2 to 7, the liquid ejection head 12 includes a housing 21, a nozzle plate 22, a base plate 23, a manifold 24, a mask plate 25, a cover mask 26, a pair of supply pipes 27*a* and 27*b*, and a pair of recovery pipes 28*a* and 28*b*.

In the present embodiment, a liquid ejection head includes the nozzle plate 22 having the plurality of nozzle holes 31 formed therein and the base plate 23.

The nozzle plate 22 is formed in a rectangular plate shape. The nozzle plate 22 has nozzle rows 31*a* and 31*b* each of which has a plurality of nozzle holes 31 arranged in the first direction.

In the present embodiment, two rows of nozzle rows 31*a* and 31*b* are connected to the ink chambers 11*a* and 11*b* having different colored inks, respectively, and eject different colored inks from the nozzle holes 31.

As illustrated in FIG. 5, the base plate 23, which is a portion of the liquid ejection head, faces a side opposite to a printing surface of the nozzle plate 22 and is supported on the mask plate 25. Inside the base plate 23, a plurality of pressure chambers 32*a* communicating with the nozzle holes 31 of the nozzle row 31*a* of the nozzle plate 22, a plurality of pressure chambers 32*b* communicating with the nozzle holes 31 of the nozzle row 31*b*, and common chambers 33*a* and 33*b* respectively communicating with the plurality of pressure chambers 32*a* and 32*b* are formed.

Actuators 34 are disposed so as to each face the pressure chambers 32*a* and 32*b*. The actuator 34 includes, for example, a unimorph type piezoelectric vibration plate in which a piezoelectric element and a diaphragm are stacked. The piezoelectric element is made of, for example, a piezoelectric ceramic material such as lead zirconate titanate (PZT) or the like. The pressure chamber is electrically connected to a wiring pattern on a circuit board by an electrode.

The manifold 24 is formed in a rectangular block shape and is attached to the base plate 23. The manifold 24 has a pair of supply paths 35*a* and 35*b* and a pair of recovery paths 36*a* and 36*b* which are flow paths communicating with the common chambers, and forms an ink flow path having a predetermined shape.

The mask plate 25 is in a frame shape including a portion of the housing 21 and covers at least a portion of an outer peripheral surface of the manifold 24.

As illustrated in FIG. 7, the cover mask 26 covers the outer peripheral edge portion of a nozzle surface 22*a* of the nozzle plate 22 and a portion of an outer peripheral surface of the mask plate 25. A gap G1 allowing air to flow is formed between the nozzle surface 22*a* and a suction surface 41*a*. A thickness of the gap G1 is determined by a thickness of the cover mask 26.

As illustrated in FIG. 2, the supply pipes 27*a* and 27*b* are tubes that form flow paths from the ink chambers 11*a* and 11*b* to the liquid ejection head 12, respectively. The liquids LQ1 and LQ2 of the ink tank 11 are respectively pumped to the liquid ejection head 12 through the supply pipes 27*a* and 27*b* by the circulation pump 13.

The recovery pipes 28*a* and 28*b* are tubes that form flow paths from the liquid ejection head 12 to the ink chambers 11*a* and 11*b* of the ink tank 11, respectively. The liquids LQ1 and LQ2 are pumped from the liquid ejection head 12 to the ink tank 11 through the recovery pipes 28*a* and 28*b* by the circulation pump 13.

The circulation pump 13 includes, for example, a piezoelectric pump. The circulation pump 13 can be controlled by a processor 81. As illustrated in FIG. 1, the processor 81 is connected to a drive circuit 84 by a wiring and provided in the control device 17. The circulation pump 13 pumps liquid in the circulation path to the downstream side.

In the example embodiments described above, the liquid ejection head 12 includes the nozzle plate 22, the base plate 23, and the manifold 24, the supply paths 35*a* and 35*b* extending from the ink chambers 11*a* and 11*b* to the pressure chambers 32*a* and 32*b* via the supply pipes 27*a* and 27*b*, and the recovery paths 36*a* and 36*b* extending from the pressure chambers 11*a* and 11*b* to the ink chambers 11*a* and 11*b* via the recovery pipes 28*a* and 28*b*. The supply path 35*a* and the recovery path 36*a* form a circulation path 30*a* connected to the ink chamber 11*a*. The supply path 35*b* and the recovery path 36*b* form a circulation path 30*b* connected to the ink chamber 11*b*. The liquid ejection head 12 ejects two kinds of liquids LQ1 and LQ2 as liquids from, for example, two rows of nozzle rows 31*a* and 31*b* so as to form a desired image on the recording medium S disposed to face the liquid ejection head 12.

As illustrated in FIGS. 2 to 7, the maintenance apparatus 14 includes a suction head 41, a first suction tube 42*a*, a second suction tube 42*b*, and an exhaust tube 43 connected to the suction head 41, a bottle 44 connected to the suction head 41 via the suction tubes 42*a* and 42*b*, a suction pump 46 connected to the bottle 44 via a connection tube 45, and an exhaust pump 47 connected to the suction head 41 via the exhaust tube 43.

A suction surface 41*a* the suction head 41 faces the nozzle surface 22*a* of the nozzle plate 22. Inclined surfaces 41*b* of the suction head 41 are at both sides of the suction surface 41 in the first direction parallel to the nozzle rows 31*a* 32*a* and inclined away from the nozzle surface 22*a*.

The suction surface 41*a* forms a plane parallel to the nozzle surface 22*a* and extends in the second direction perpendicular to the nozzle rows 31*a* and 31*b*. Regulation walls 41*c* are formed at both end portions of the suction head 41 in the second direction and engage with end edges of the cover mask 26 to regulate a position with respect to the liquid ejection head 12.

A first suction nozzle 51*a*, a second suction nozzle 51*b*, and an exhaust nozzle 53 are formed inside the suction head 41. One end of the first suction nozzle 51*a* forms a first suction port 52*a* which opens to the first nozzle row 31*a* at the suction surface 41*a*. The other end of the first suction nozzle 51*a* is connected to the suction tube 42*a* via a pipe joint 48*a*. One end of the second suction nozzle 51*b* forms a second suction port 52*b* which opens to the second nozzle row 31*b* at the suction surface 41*a*. The other end of the first suction nozzle 51*a* is connected to the suction tube 42*b* via a pipe joint 48*b*.

One end of the exhaust nozzle 53 forms a discharge port 53*a* which opens to the suction surface and is disposed to face portion between the first nozzle row 31*a* and the second nozzle row 31*b*. The other end of the exhaust nozzle 53 is connected to the exhaust tube 43 via a pipe joint 48*c*.

The suction surface 41*a* is spaced away from the nozzle surface 22*a* with the gap G1. The thickness of the gap G1 between the suction surface 41*a* and the nozzle, the width of the suction surface 41*a* in the first direction, sizes of the suction ports 52*a* and 52*b*, the discharge port 53*a*, and the like are set as to allow an air flow in suction processing. The suction head 41 is movable by the transport device 15 in the direction indicated by the arrow in FIG. 4.

The suction pump 46 and the exhaust pump 47 may be for example, a diaphragm type pump. The suction pump 46 has a suction port 46*a* and an exhaust port 46*b*. The exhaust pump 47 has a suction port 47*a* and an exhaust port 47*b*. The bottle 44 is connected to the suction port 46*a* of the suction pump 46 by the connection tube 45. The exhaust port 46*b* of the suction pump 46 is open at all times. The suction port 47*a* of the exhaust pump 47 is open and the exhaust port 47*b* communicates with the exhaust nozzle 53 via the exhaust tube 43 and the pipe joint 48*c*.

The transport device 15 transports the recording medium and moves the maintenance apparatus 14 with respect to the liquid ejection head 12. For example, the transport device 15 includes a moving mechanism that supports the suction head 41 and reciprocates between a standby position and a maintenance position. The transport device 15 includes a recording medium transport mechanism that holds and transports the recording medium. The transport device 15 includes a head movement mechanism that moves the liquid ejection head 12 at according to various printing conditions.

The interface 16 illustrated in FIG. 1 includes a power source, a display device, and an input device. The interface 16 is connected to a processor 81. The processor 81 acquires various a user's instructions from the input device of the interface 16. The processor 81 controls the display device of the interface 16 to display various information and images.

The control device 17 includes the processor 81 for controlling the operation of each element, a memory 82 for storing a program or data, an A/D conversion unit 83 for converting analog data such as voltage value into digital data (also referred to as bit data), a drive circuit 84 for driving each element of the liquid ejection apparatus 1, and an amplification circuit.

The processor 81 includes a central processing unit (CPU). The processor 81 controls each element of the liquid ejection apparatus 1 so as to implement various functions of the liquid ejection apparatus 1 according to an operating system or an application program.

The processor 81 controls the operation of each unit of the liquid ejection apparatus 1 via a drive circuit 84 connected to various drive mechanisms.

By executing control processing based on a control program stored in the memory 82 in advance by the processor 81, for example, the processor 81 controls the operations of the liquid ejection head 12 and the circulation pump 13 to control a printing operation.

When an input instructing the start of a printing process is detected, the processor 81 controls the operations of the liquid ejection head 12 and the transport device 15 according to various programs so as to eject liquid coating material from the nozzle holes 31.

The memory 82 is, for example, a nonvolatile memory and installed on the control device 17. Various control programs and operation conditions are stored in the memory as information necessary for controlling an ink circulation operation, an ink supply operation, temperature management, liquid level management, pressure management, and the like.

The operation of the liquid ejection apparatus 1 will be described. The processor 81 detects, for example, a print instruction by a user through the input device of the interface 16. When the print instruction is detected, the processor 81 drives the transport device 15 to transport a sheet P and outputs a print signal to the liquid ejection head 12 at a predetermined timing to cause the liquid ejection head 12 to be driven. As the ejection operation, the liquid ejection head 12 ejects ink from the nozzle hole 31 by selectively driving the piezoelectric element by an image signal in accordance with image data and forms an image on the recording medium held at a facing position.

The processor 81 drives the circulation pump 13 so as to circulate liquid in the two circulation flow paths 30*a* and 30*b* passing through the ink tank 11 and the liquid ejection head 12.

The memory 82 is, for example, a nonvolatile memory, and is installed on a control board which is, for example, the control device 17. Various control programs and operation conditions are stored in the memory 82 as information necessary for controlling the ink circulation operation, the ink supply operation, pressure adjustment, temperature management, liquid level management of ink, and the like.

The processor 81 drives the transport device 15 at a predetermined timing to move the maintenance apparatus to a head position and drives the suction pump 46 and the exhaust pump 47 to perform cleaning processing.

In cleaning processing, the suction head 41 moves while contacting and sliding with the cover mask 26 and suctions and cleans residual ink, dust, and the like remaining on the nozzle surface 22*a* by negative pressure and the air flow provided by the suction pump.

Specifically, air is blown to a predetermined position of the nozzle surface 22*a* from the discharge port 53*a* between the pair of suction ports 52*a*, 52*b* by driving the exhaust pump 47, and an air curtain is thus formed.

In this case, air flows into a space formed by the inclined surfaces 41*b* through the gap G1 between the suction ports 52*a* and 52*b* and the nozzle surface 22*a*.

Due to a flow of air sucked from the suction ports 52*a* and 52*b* generated by the suction pump 46, liquid adhered to the first nozzle row 31*a* is sucked together with dust and recovered in the bottle 44 via the suction tube 42*a*. Similarly, liquid adhered to the second nozzle row 31*b* is sucked together with dust and recovered in the bottle 44 via the suction tube 42*b*.

The maintenance apparatus 14 and the liquid ejection apparatus 1 include two suction mechanisms respectively corresponding to the nozzle rows 31*a* and 31*b* that eject different inks, such that the different inks are not mixed. Air or any other gas flows between the suction ports 52*a* and 52*b* such that an air curtain that separates the suction ports 52*a* and 52*b* from each other. Thus, it is possible to prevent mixtures of different inks.

The inclined surfaces 41*b* inclined away from the nozzle surface 22*a* are formed on both sides of the suction surface 41*a* in the first direction proximate to the nozzle surface 22*a* such that air can flow smoothly and a high suction force can be obtained.

The present invention is not limited to the embodiment described above as it is, and constitutional elements can be modified and materialized at an implementation stage without departing from the gist thereof.

For example, in the example embodiments described above, the suction pump 46 and the exhaust pump 47 are respectively provided, but is not limited to this example. For example, the exhaust nozzle 53 may be connected to the exhaust port 46*b* of the suction pump 46 so as to make it also possible to use the suction pump 46 as a pump for exhaust and intake.

In the example embodiments described above, the two suction nozzles 51*a* and 51*b* are connected to the common bottle 44 and the common bottle 44 is connected to the common suction pump 46, but is not limited to this example. The suction nozzles 51*a* and 51*b* may be respectively connected to different bottles and different pumps.

In the example embodiments described above, the liquid ejection head 12 includes two nozzle rows 31*a* and 31*b* for ejecting two kinds of liquids, but the number of nozzle rows is not limited to two. For example, for ejecting three or more kinds of liquids, suction nozzles having three or more flow paths may be formed.

The liquid to be ejected is not limited to ink and liquids other than ink can be ejected. A liquid other than ink such as liquid containing conductive particles for forming a wiring pattern on a printed wiring circuit board or the like may be ejected from the liquid ejection head 12.

The liquid ejection head 12 may have a structure for ejecting ink droplets by deforming a vibration plate with piezoelectric actions, a structure for ejecting ink droplets from a nozzle using thermal energy from a heater, and the like.

In the example embodiments described above, the liquid ejection apparatus 1 is used in an ink jet recording apparatus. However, the application is not limited to this example. For example, the liquid ejection apparatus 1 may also be used in a 3D printer, an industrial-scale manufacturing machine, and medical applications and reductions in size, weight, and cost may also be achieved in the liquid ejection apparatus 1 or the like.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the present disclosure.

What is claimed is:

1. A maintenance apparatus, comprising:

a plurality of first nozzle holes aligned in a first direction on a nozzle plate;

a plurality of second nozzle holes aligned in the first direction on the nozzle plate;

a first suction nozzle having a first suction port facing at least one first nozzle hole through which a first liquid can be ejected;

a second suction nozzle having a second suction port facing at least one second nozzle hole through which a second liquid can be ejected; and an exhaust nozzle including a discharge port between the first suction port and the second suction port, wherein gas flows through the discharge port.

2. The apparatus according to claim 1, further comprising:

a suction pump having a suction port and an exhaust port, the suction port of the suction pump being connected to a bottle and the exhaust port of the suction pump being connected to the exhaust nozzle, wherein the suction pump is configured to exhaust gas into and intake gas from the discharge port of the exhaust nozzle.

3. The apparatus according to claim 1, further comprising:

an exhaust pump having a suction port and an exhaust port, wherein the suction port of the exhaust pump is open to atmosphere, and the exhaust port of the exhaust pump is connected to the exhaust nozzle.

4. The apparatus according to claim 1, wherein the first and second suction nozzles are moveable along the first direction.

5. The apparatus according to claim 4, wherein a suction surface of the first and second suction nozzles facing the nozzle plate is spaced from the nozzle plate by a gap in a second direction, the second direction crossing the first direction.

6. The apparatus according to claim 5, wherein both sides of the suction surface in the first direction are angled away from the nozzle plate.

7. A liquid ejection apparatus, comprising:

a first nozzle row through which a first liquid can be ejected, the first nozzle row including nozzles aligned in a first direction on a nozzle plate;

a second nozzle row through which a second liquid can be ejected, the second nozzle row including nozzles aligned in the first direction on the nozzle plate and in parallel with the first nozzle row;

a first suction nozzle having a first suction port facing at least one first nozzle;

a second suction nozzle having a second suction port facing at least one second nozzle; and an exhaust nozzle including a discharge port between the first suction port and the second suction port, wherein gas flows to the first suction port and/or the second suction port through the discharge port.

8. The apparatus according to claim 7, further comprising:

a suction pump having a suction port and an exhaust port, the suction port of the suction pump being connected to a bottle and the exhaust port of the suction pump being connected to the exhaust nozzle, wherein the suction pump is configured to exhaust gas into and intake gas from the discharge port of the exhaust nozzle.

9. The apparatus according to claim 7, further comprising:

an exhaust pump having a suction port and an exhaust port, wherein the suction port of the exhaust pump is open to atmosphere, and the exhaust port of the exhaust pump is connected to the exhaust nozzle.

10. The apparatus according to claim 7, wherein the first and second suction nozzles are moveable along the first direction.

11. The apparatus according to claim 10, wherein a suction surface of the first and second suction nozzles facing the nozzle plate is spaced from the nozzle plate by a gap in a second direction, the second direction crossing the first direction.

12. The apparatus according to claim 11, wherein both sides of the suction surface in the first direction are angled away from the nozzle plate.

13. A liquid ejection apparatus, comprising:

a liquid ejection head including a plurality of nozzles aligned in a first direction on a nozzle plate;

a maintenance apparatus including a suction nozzle having a suction port facing at least one nozzle on the nozzle plate;

an exhaust nozzle including a discharge port adjacent to the suction port of the suction nozzle in a second direction crossing the first direction; and a suction pump having a suction port and an exhaust port, the suction port of the suction pump being connected to a bottle and the exhaust port of the suction pump being connected to the exhaust nozzle, wherein gas flows through the discharge port, and the suction pump is configured to exhaust gas into and intake gas from the discharge port of the exhaust nozzle.

14. The apparatus according to claim 13, wherein the suction nozzle is configured to move along the first direction with respect to the plurality of nozzles.

15. The apparatus according to claim 14, wherein a suction surface of the suction nozzle is spaced from the nozzle plate by a gap.

16. The apparatus according to claim 15, wherein both sides of the suction surface in the first direction are angled away from the nozzle plate.

* * * * *